US006419530B1

(12) United States Patent
Holdenried et al.

(10) Patent No.: US 6,419,530 B1
(45) Date of Patent: Jul. 16, 2002

(54) ELECTRIC PLUG-IN CONNECTOR

(75) Inventors: Willy Holdenried, Immenstaad; Hubert Remmlinger, Friedrichshafen; Karlheinz Mayr, Wasserburg; Wolfgang Schmid, Langenargen, all of (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 0 days.

(21) Appl. No.: 09/674,587

(22) PCT Filed: May 3, 1999

(86) PCT No.: PCT/EP99/02980

§ 371 (c)(1),
(2), (4) Date: Nov. 2, 2000

(87) PCT Pub. No.: WO99/59226

PCT Pub. Date: Nov. 18, 1999

(30) Foreign Application Priority Data

May 9, 1998 (DE) ..... 198 20 901

(51) Int. Cl.[7] ..... H01R 4/48

(52) U.S. Cl. ..... 439/860; 439/24; 439/63; 439/660; 439/859

(58) Field of Search ..... 439/860, 660, 439/668, 859, 913, 224, 26, 63, 24

(56) References Cited

U.S. PATENT DOCUMENTS

| | | | | | |
|---|---|---|---|---|---|
| 955,747 | A | * | 4/1910 | Barcy | 439/342 |
| 1,386,831 | A | * | 8/1921 | Austin | 439/342 |
| 2,291,674 | A | * | 8/1942 | Alden | 439/342 |
| 2,645,759 | A | | 7/1953 | Solari | |
| 2,764,746 | A | | 9/1956 | Terlinde | |
| 3,546,656 | A | * | 12/1970 | Pritulsky | 439/342 |
| 3,728,669 | A | * | 4/1973 | Churla | 339/253 |
| 4,230,392 | A | | 10/1980 | Leonard, Jr. et al. | |
| 4,402,897 | A | | 9/1983 | Cross et al. | 264/118 |
| 4,671,589 | A | | 6/1987 | Tackett | 439/592 |
| 5,344,335 | A | * | 9/1994 | Scholz et al. | 439/357 |

FOREIGN PATENT DOCUMENTS

| | | |
|---|---|---|
| DE | 37 38 249 A1 | 5/1988 |
| DE | 196 39 585 A1 | 4/1998 |
| DE | 196 41 908 A1 | 4/1998 |
| FR | 2 519 810 | 7/1983 |

* cited by examiner

*Primary Examiner*—Tho D. Ta
*Assistant Examiner*—Truc Nguyen
(74) *Attorney, Agent, or Firm*—Davis & Bujold, P.L.L.C.

(57) ABSTRACT

An electric plug-in connector (11) having at least two coaxial round contacts (12, 13) provided on an electric component, e.g. a pressure regulator (10) or the like, wherein one round contact, preferably the inner round contact (12), contains an adjustment mechanism. There is further provided one connector (17) having at least two plug-in contacts for connection with the round contacts (12, 13). The plug-in connector (11) has hooks which are configured in such a way that in a plane which extends, e.g. perpendicular to the longitudinal axis (21) of the round contacts (12, 13), the connector (17) can be inserted onto the round contacts from any direction and can be locked thereon and/or on the pressure regulator (10) and the adjustment mechanisms is freely accessible in the inner round contact (12).

10 Claims, 4 Drawing Sheets

ELECTRIC PLUG-IN CONNECTOR

The invention relates to an electric plug-in connector having at least two round contacts provided on an electric component, such as a magnetic valve, a pressure regulator, or the like. One round contact, preferably the inner one, contains one adjustment means. To connect the round contacts with one other electric component, a connector is provided which has at least two plug-in contacts.

BACKGROUND OF THE INVENTION

Plug-in connectors of the above mentioned kind are fully known from the prior art. In such plug-in connectors, it is a disadvantage that for assembly the connector has to be aligned in a predetermined position relative to the electric component in order that the connector is contacted and locked on the component. In addition, since in actuating elements, such as a pressure regulator, an adjustment is often required and the adjustment means usually is situated centrally on a front side of the component onto which the connector can also be inserted, the adjustment necessarily has to take place prior to insertion of the connector onto the contacts.

The problem on which this invention is based is to indicate an electric plug-in connector for electric components which, on one hand, does not require a structurally predetermined alignment of the individual connector with the contacts and, on the other hand, allows free access of the adjustment means possible even after the connector has been set upon the contacts.

SUMMARY OF THE INVENTION

According to the invention, this problem is solved by the fact that in a plane that extends, e.g. perpendicular to the longitudinal axis of the round contacts, the connector can be inserted onto the round contacts and can be locked onto the same and/or the electric component from any direction, and that the adjustment means is freely accessible. Thus, the connector can advantageously be inserted onto the round contacts at least on one plane independently of direction and also likewise independently of the direction of insertion onto the round contacts themselves and/or the electric component. The plug-in connector, especially the connector, is also designed in a manner such that the adjustment means is advantageously freely accessible even after the connector has been set upon the contacts.

In a development of the invention, the connector has at least two plug-in contacts superimposed on each other and designed as U-shaped spring shackles whose openings point in the same direction. Thereby it is advantageously made possible that the connector is easily and safely insert able simultaneously onto both round contacts and that an insulator can be provided between the two plug-in contacts for separating the two round contacts.

The connector and/or the round contacts and/or the component itself advantageously have at least one detent hook and one detent notch for axial and/or radial locking of the connector on the round contacts, the indication of axial and radial referring to the longitudinal axis of the round contacts.

In a preferred embodiment, it is proposed to provide, concentrically in relation to the longitudinal axis of the round contacts, a ring gear which has radially outwardly opened detent notches in which, in turn, meshes at least one detent lug mounted on another component for locking the connectors in peripheral direction. With the inventive detent means, like the ring gear with detent notches and the corresponding detent lug, a design is advantageously proposed which, in a defined plane, makes inserting and locking the connector from almost any direction possible, since the detent lug can be locked in any detent notch provided on the periphery of the ring gear.

The ring gear is advantageously provided directly on the electric component and the corresponding detent lug on the connector. Thereby a solution is proposed which, with simple means, makes it possible to secure the connector in a peripheral direction on the component without the connector having to be inserted in a certain direction onto the contacts.

In one other embodiment, it is proposed that the connector encompasses the ring gear at least on its upper and/or lower side. This can be done, e.g. by means of a supporting surface and a detent hook on the connector. Thereby it is advantageously made possible to provide an easy locking of the connector in an axial direction relative to the longitudinal axis of the contacts or the longitudinal axis of the pressure regulator.

To secure the connector to the electric component in a radial direction, a detent hook, e.g. is proposed, which is resiliently supported on the connector. The detent hook can be locked with the front side of the inner round contact by pushing thereon the connector on a plane perpendicular to the longitudinal axis of the contact.

The detent hook also has a recess designed and disposed in such a manner that the adjusting means, such as a set screw located in the interior of the round contact, is freely accessible from the front side of the round contact when the connector is pushed. The recess can advantageously be designed as a hole through which the head of the set screw can be satisfactorily reached even after the connector has been set on.

In another development of the invention, it is proposed that the electric plug-in connector be designed in modular construction, wherein several electric components, such as several pressure regulators, form a contact strip connectable with a connector strip having several connectors. Such an embodiment advantageously makes possible a quick and easy assembly of the connectors on the electric components. At the same time, several electric components, such as pressure regulators, are situated in a common housing equidistant next to each other, the detent lug on the connector or the connector strip for locking the individual connectors in a peripheral direction being advantageously eliminated, since the connector strip is supported on the contact strip and thus the individual connectors are locked in a peripheral direction.

BRIEF DESCRIPTION OF THE DRAWINGS

Other objectives, features, advantages and possible application of the invention result from the description that follows of the embodiments which are shown in detail in the drawings. All the features described and/or graphically shown form the object of the invention by themselves or in any logical combination independently of their composition in the claims and the relationship thereof. In the drawings:

DESCRIPTION OF THE PREFERRED EMBODIMENTS

Figure 1:
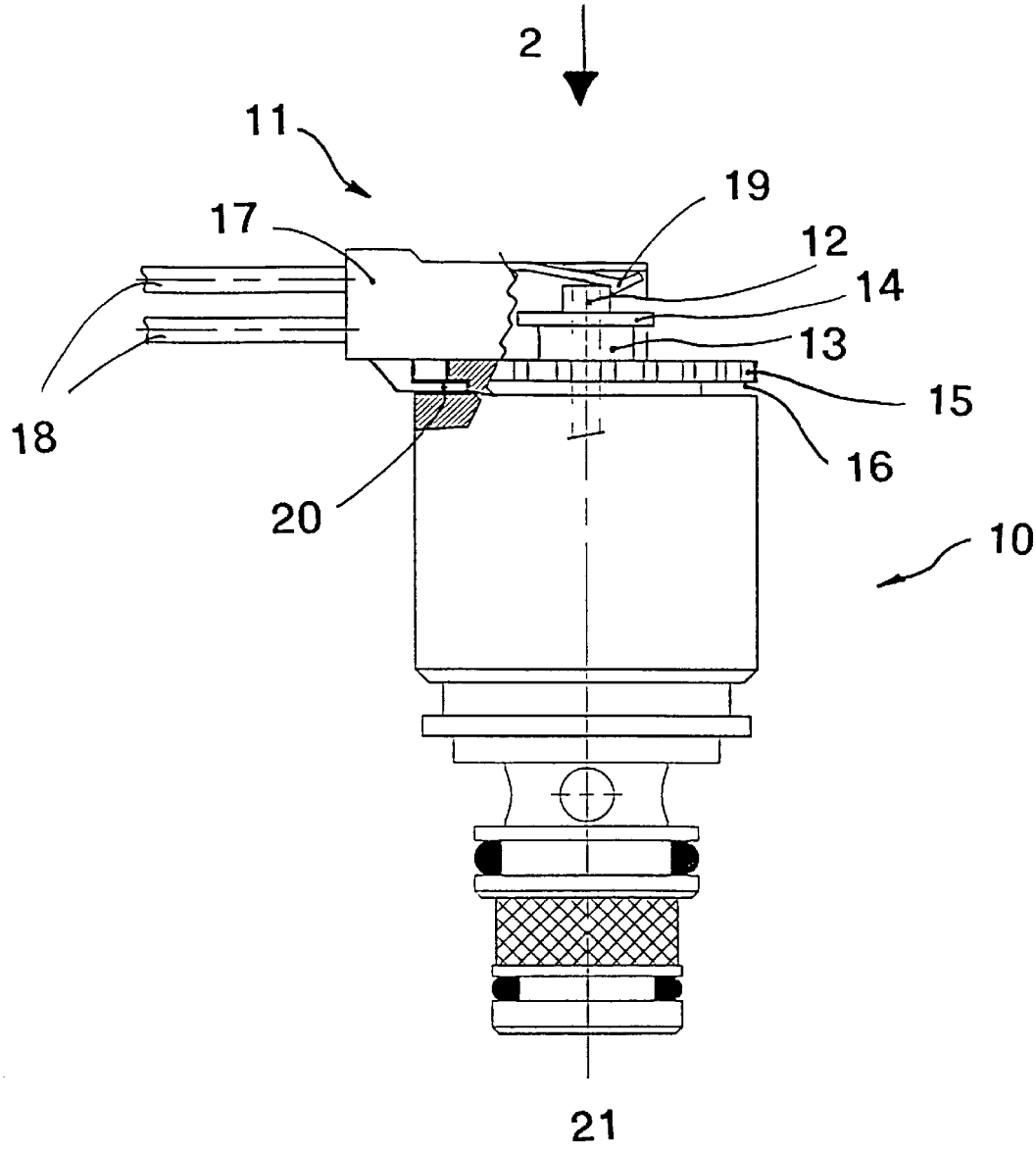
FIG. 1 is a side view of the pressure regulator with inventive plug-in connector in partially broken up and enlarged representation.

The pressure regulator 10 (FIG. 1) has a substantially dynamically balanced design around its longitudinal axis 21. On its upper front side an inner round contact 12 and an outer round contact 13 are separated from each other by an insulator 14, the inner round contact projecting in an axial direction above the outer round contact. Besides, a ring gear 15 is provided which is situated concentrically relative to the longitudinal axis 21 and spaced from the upper front side of the housing of the pressure regulator 10 by a circular groove 16.

The plug-in connector 11 further consists of a connector 17 with cables 18 for connection with one other electric element. The connector 17 is disposed in a position locked with the pressure regulator 10 in a manner such that its main extension of direction runs substantially perpendicular to the longitudinal axis 21 of the pressure regulator 10. On the connector 17 is placed a resiliently supported detent hook 19 which, when the connector 17 is pushed upon the contacts 12 and 13, locks on a plane perpendicular to the longitudinal axis 21 with the inner round contact 12, and to detach the plug-in connector 11, the detent hook 19 is lifted from the round contact 12 and the connector 17 can be laterally shoved off.

Figure 2:
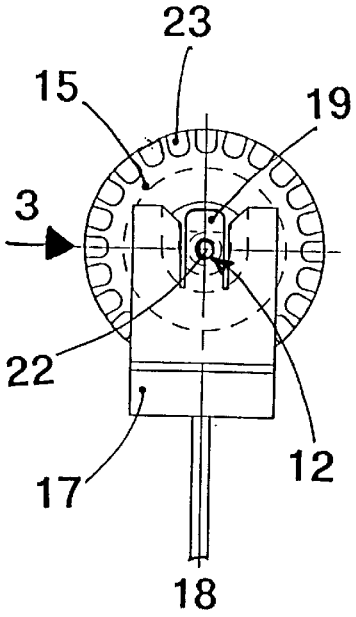
FIG. 2 is a top view of a plug-in connector according to view 2 in FIG. 1.

The ring gear 15 (FIG. 2) is provided on its outer periphery with equidistant detent notches 23. The connector 17 is pushed in the radial direction to the ring gear 15 so that the detent hook 19 covers the inner round contact, and the recess 22 in the detent hook 19 is situated centrally over the round contact 12.

Figure 3:
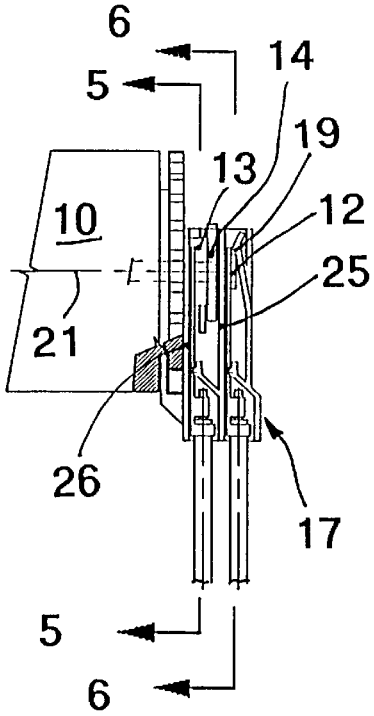
FIG. 3 is a side view of a plug-in connector according to FIG. 2 in partially broken up representation.

The connector 17 (FIG. 3) is situated substantially perpendicular to the longitudinal axis 21 of the pressure regulator 10. At the same time, the inner plug-in contact 25 encompasses the inner round contact 12 and an outer plug-in contact 26, the outer round contact 13, an insulator 14 being provided between the two contacts 25 and 26.

The connector 17 (FIG. 4) contains a detent hook 19 which has a hole 22. A detent lug 24 is situated on the connector 17 so that the detent lug 24, when the connector is pushed on the contacts, engages in a detent notch 23 of the ring gear 15 and the hole 22 freely leaves the adjusting means in the inner round contact accessible.

Figure 5:
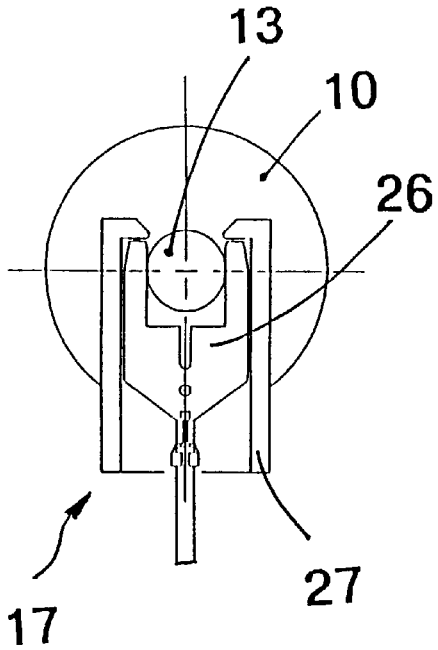
FIG. 5 is a transverse section of a plug-in connector along line 5—5 in FIG. 3.

The connector 17 (FIG. 5) contains a U-shaped outer plug-in contact 26 which has two spring brackets and is surrounded by a connector housing 27. The dimension of the U-shaped recess of the contact 26 is such that the outer plug-in contact 26 precisely encompasses and clamps the outer round contact 13 on the pressure regulator 10.

Figure 6:
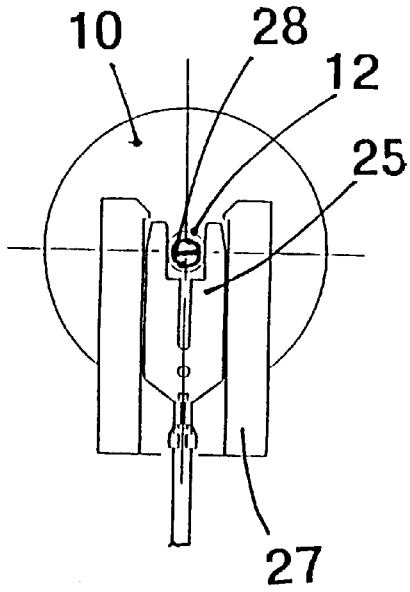
FIG. 6 is a transverse section of a plug-in connector along the line 6—6 in FIG. 3.

The inner plug-in contact 25 (FIG. 6) is likewise designed as U-shaped plug-in contact, the recess thereof being precisely configured so that the inner plug-in contact 25 surrounds and clamps the inner round contact 12. The inner round contact 12 contains a set screw 28 slotted on its head end which traverses in an axial direction the inner round contact 12 and extends into the pressure regulator 10.

Figure 4:
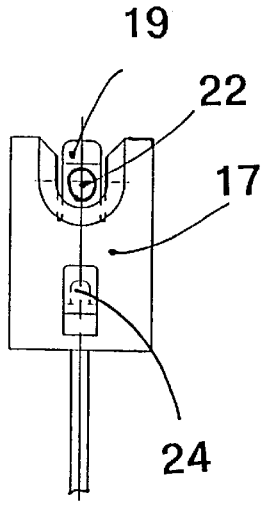
FIG. 4 is a top view of an inventive connector.
Figure 7:
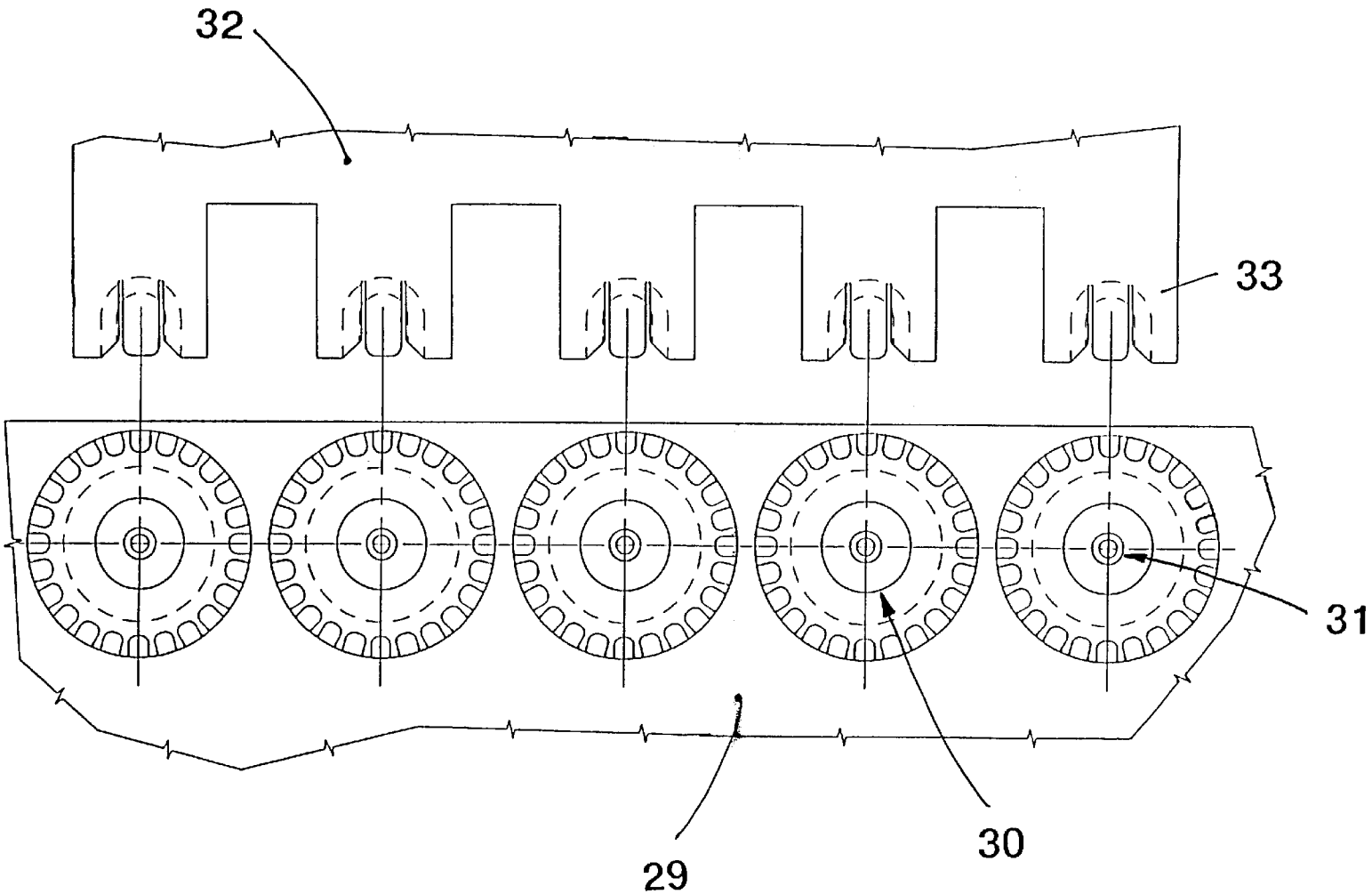
FIG. 7 is a top view of an electric plug-in connector in another embodiment in modular design in separate representation.

In the modular design (FIG. 7), the valve housing 29 contains several pressure regulators 30 which are arranged in one line equidistant from each other. The inner and outer round contacts of the individual pressure regulators 30 thus form a contact strip 31. A corresponding connector strip 32 contains several individual connectors 33 which are arranged so that the connectors 33 which are arranged so that the connectors 33 can be simultaneously inserted onto the contact strip 31. A detent lug 24 for locking the connector in a peripheral direction, as shown in FIG. 4, is advantageously unnecessary, since the connector strip 32 supports itself on the contact strip 31 by the abutment of several connectors 33 on several pressure regulators 30 and thereby the connectors are locked in a peripheral direction.

Reference numerals

2 view
3 view
5 section
6 section
10 pressure regulator
11 plug-in connector
12 inner round contact
13 outer round contact
14 insulator
15 ring gear
16 groove/detent notch
17 connector
18 cable
19 detent hook
20 detent book
21 longitudinal axis
22 recess/hole
23 detent notch
24 detent lug
25 inner plug-in contact
26 outer plug-in contact
28 set screw
29 valve housing
30 pressure regulator
31 contact strip
32 connector strip
33 connector

What is claimed is:

1. An electric plug-in connection (11) comprising:

at least two round contacts (12, 13) provided on an electric component (10) and one connector (17), the at least two round contacts including an inner round contact and an outer round contact wherein the inner round contact projects in an axial direction above the outer round contact, the axis of the inner round contact being coincident with the axis of the outer round contact, the connector including at least two plug-in contacts (25, 26) for connection with corresponding ones of said round contacts (12, 13) wherein said plug-in connector includes a detent means to retain said connector in connection with said round contacts, the plug-in contacts being configured so that the plug-in contacts of said connector (17) can be inserted into connection with said round contacts along a plane extending perpendicular to the longitudinal axis (21) of said round contacts (12, 13) and at any angle of rotation around said longitudinal axis (21) of said round contacts (12, 13) and can be locked thereon by said detent means, and wherein one round contact contains one adjusting means for said electric component and said adjusting means is freely accessible.

2. The electric plug-in connector according to claim 1, wherein said connector (17) has at least two plug-in contacts (25, 26) superposed on each other and configured as U-shaped spring shackles whose openings point in the same direction.

3. The electric plug-in connector according to claim 1, wherein said connector (17) and said round contacts (12, 13) have at least one detent hook (19, 20) and one detent notch (16, 23) for locking of said connector (17) relative to the longitudinal axis (21) of said round contacts (12, 13).

4. The electric plug-in connector according to claim 1, wherein said connector (17) has a detent hook (19) which can be locked with a front side of said inner round contact (12).

5. The electric plug-in connector according to claim 1, wherein said plug-in connector has a modular design wherein several electric components, form a contact strip (31) which can be connected with a connector strip (32) having several of said connectors (33).

6. The electric plug-in connector according to claim 1, wherein said connector (17) and said component (10) have at least one detent hook (19, 20) and one detent notch (16, 23) for locking of said connector (17) relative to the longitudinal axis (21) of said round contacts (12, 13).

7. An electric plug-in connection (11) comprising:

at least two round contacts (12, 13) provided on an electric component (10) and one connector (17), the at least two round contacts including an inner round contact and an outer round contact wherein the inner round contact projects in an axial direction above the outer round contact, the axis of the inner round contact being coincident with the axis of the outer round contact, the connector including at least two plug-in contacts (25, 26) for connection with corresponding ones of said round contacts (12, 13) wherein said plug-in connector includes a detent means to retain said connector in connection with said round contacts, the plug-in contacts being configured so that the plug-in contacts of said connector (17) can be inserted into connection with said round contacts along a plane extending perpendicular to the longitudinal axis (21) of said round contacts (12, 13) and at any angle of rotation around said longitudinal axis (21) of said round contacts (12, 13) and can be locked thereon by said detent means, and wherein one round contact contains one adjusting means for said electric component and said adjusting means is freely accessible, and further comprising:

a ring gear located (15) concentrically with and perpendicular to said longitudinal axis (21) of said round contacts (12, 13) and having radially outwardly open detent notches (23) in which engages at least one detent lug (24) for locking said connector (17) in peripheral direction relative to the axis of said round contacts (12, 13).

8. The electric plug-in connector according to claim 7, wherein said ring gear (15) is situated on said electric component (10) and said detent lug (24) on said connector (17).

9. The electric plug-in connector according to claim 7, wherein said connector (17) encompasses said ring gear (15) at least range-wise on the upper and/or lower side thereof.

10. An electric plug-in connection (11) comprising:

at least two round contacts (12, 13) provided on an electric component (10) and one connector (17), the at least two round contacts including an inner round contact and an outer round contact wherein the inner round contact projects in an axial direction above the outer round contact, the axis of the inner round contact being coincident with the axis of the outer round contact, the connector including at least two plug-in contacts (25, 26) for connection with corresponding ones of said round contacts (12, 13) wherein said plug-in connector includes a detent means to retain said connector in connection with said round contacts, the plug-in contacts being configured so that the plug-in contacts of said connector (17) can be inserted into connection with said round contacts along a plane extending perpendicular to the longitudinal axis (21) of said round contacts (12, 13) and at any angle of rotation around said longitudinal axis (21) of said round contacts (12, 13) and can be locked thereon by said detent means, and wherein one round contact contains one adjusting means for said electric component and said adjusting means is freely accessible, wherein said connector (17) has a detent hook (19) which can be locked with a front side of said inner round contact (12), and wherein said detent hook (19) has one recess (22) which is situated in a manner such that a set screw located in the interior of said round contact (12) is accessible from the front side of said round contact (12) when the connector (17) is set upon said contacts (12, 13).

* * * * *